US009261267B2

(12) United States Patent
Harrison et al.

(10) Patent No.: US 9,261,267 B2
(45) Date of Patent: Feb. 16, 2016

(54) HYBRID REFLECTOR INCLUDING LIGHTGUIDE FOR SENSOR

(75) Inventors: Robert Harrison, North Andover, MA (US); Napoli Oza, Boise, ID (US); Ming Li, Acton, MA (US); Ronald Roberts, Melrose, MA (US); Anil Jeswani, Beverly, MA (US)

(73) Assignee: OSRAM SYLVANIA INC., Wilmington, MA (US)

( * ) Notice: Subject to any disclaimer, the term of this patent is extended or adjusted under 35 U.S.C. 154(b) by 875 days.

(21) Appl. No.: 13/460,798

(22) Filed: Apr. 30, 2012

(65) Prior Publication Data

US 2012/0274217 A1 Nov. 1, 2012

Related U.S. Application Data

(60) Provisional application No. 61/481,030, filed on Apr. 29, 2011, provisional application No. 61/481,478, filed on May 2, 2011.

(51) Int. Cl.

| | |
|---|---|
| ***H05B 41/36*** | (2006.01) |
| ***F21V 23/04*** | (2006.01) |
| ***F21K 99/00*** | (2010.01) |
| ***F21V 7/22*** | (2006.01) |
| *F21Y 101/02* | (2006.01) |

(52) U.S. Cl.

CPC ..... *F21V 23/0457* (2013.01); *F21K 9/54* (2013.01); *F21V 7/22* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 5,337,179 | A | 8/1994 | Hodges | |
| 8,314,566 | B2 * | 11/2012 | Steele et al. | 315/185 R |
| 2006/0226336 | A1 | 10/2006 | York et al. | |
| 2007/0001177 | A1 | 1/2007 | Bruning et al. | |
| 2008/0093530 | A1 | 4/2008 | Hoelen et al. | |
| 2009/0201677 | A1 | 8/2009 | Hoelen et al. | |

OTHER PUBLICATIONS

Marc Chaloupy, International Search Report and Written Opinion of the International Searching Authority, Oct. 30, 2012, pp. 1-11, European Patent Office, Rijswijk, The Netherlands.

* cited by examiner

*Primary Examiner* — Cassandra Cox

(74) *Attorney, Agent, or Firm* — Shaun P. Montana

(57) ABSTRACT

A luminaire is providing, having a substrate of a particular shape and a plurality of solid state light sources mounted thereon. The plurality has a measurable characteristic and includes an adjustable solid state light source, such that the characteristic changes in response to adjustment thereof. The luminaire also includes a sensor that detects the characteristic from outputted light, compares it to a baseline value and, based on the comparison, so adjusts the adjustable solid state light source. The luminaire also includes a reflector with a lower edge that conforms to the particular shape of the substrate, and reflects outputted light from the plurality so that it exits past the reflector's upper edge. The luminaire also includes a lightguide having an input that is surrounded by the reflector and captures a portion of the outputted light so as to provide the captured outputted light to the sensor.

18 Claims, 5 Drawing Sheets

HYBRID REFLECTOR INCLUDING LIGHTGUIDE FOR SENSOR

CROSS-REFERENCE TO RELATED APPLICATIONS

The present application claims priority of U.S. Provisional Application No. 61/481,030, entitled "HYBRID REFLECTOR FOR LUMINAIRE" and filed Apr. 29, 2011, and U.S. Provisional Application No. 61/481,478, entitled "LIGHTGUIDE FOR SENSOR" and filed May 2, 2011, the entire contents of both of which are hereby incorporated by reference.

TECHNICAL FIELD

The present invention relates to lighting, and more specifically, to reflecting and adjusting the output of a light source.

BACKGROUND

As solid state light sources have increased in efficiency and decreased in cost, they are more commonly being used in products as general illumination sources. One way of generating white light and/or substantially white light from solid state light sources is to use a yellow phosphor, whether directly on a chip or remote, to convert blue light from the solid state light sources to a substantially white light. An alternative technique is known as color mixing. In color mixing, light emitted from solid state light sources of two colors (e.g., greenish-white ("mint") and amber ("red")) or three colors (e.g., red, green, and blue) is mixed together to create white light and/or substantially white light. In such color mixing applications, it is generally desirable to sense the light being output and to adjust it as the solid state light sources change over time, to maintain a similar and/or near similar color of light.

SUMMARY

Within a conventional luminaire, one or more solid state light sources typically are attached to a substrate, such as but not limited to a printed circuit board. The substrate may take any shape, but is typically planar with an outer edge. Of course, typically other electrical components (e.g., resistor(s), capacitor(s), inductor(s), microcontrollers, integrated chips, etc.) are also attached to the substrate. The substrate is then mounted on a surface, typically a thermal management system (i.e., heat sink), so as to dissipate the heat generated by the solid state light source(s). A reflector is typically attached to the thermal management system, to collect the light emitted by the solid state light source(s) and aid in ejecting the emitted light from the luminaire, typically through an optic.

The surface to which the substrate is mounted, the reflector, and the optic, among other things, typically form an interior chamber in which the solid state light source(s) is(are) located within the luminaire. In order to collect as much light as possible from the interior chamber, it is desirable to have as much of the interior chamber as possible be reflective. This has been achieved by a number of modifications to the interior of the chamber, including coating the substrate with a reflective material, coating the surface with a reflective material, making the substrate and/or the surface from a reflective material, and the like. Such coating(s), however, may decrease in reflectance over time, and typically the components mounted on the substrate are themselves not coated, decreasing the efficacy of such solutions. Additionally, a reflector in such a luminaire may include one or more openings that serve as lightguides, to bring a portion of the light emitted by the solid state light source(s) back to a sensor that is then able to adjust the output of at least one solid state light source, to achieve a desirable light output. The size and number of such openings further decrease the overall reflectance of the interior chamber.

Embodiments described herein overcome such deficiencies by providing a hybrid reflector and lightguide, where the hybrid reflector is made from two materials so that the hybrid reflector is able to conform to the shape of the substrate and cover as much of the substrate as possible, and the lightguide collects light from outside the interior chamber. The hybrid reflector has two portions, a lower portion near the substrate and an upper portion near where the emitted light exits the luminaire. The lower portion is made of a material having a very high reflectance, e.g., 95% reflectance, and the upper portion is made of a material having an even higher reflectance, e.g., 99% reflectance. As the lower portion conforms to the substrate, and in some embodiments, covers at least a portion of it and the components thereon, the overall reflectance of the luminaire is improved over a luminaire having a conventional reflector. The lightguide, by collecting light as it leaves the luminaire, does not require any openings in the reflector, further contributing to the overall high reflectance thereof.

In an embodiment, there is provided a luminaire. The luminaire includes: a substrate having a particular shape; a plurality of solid state light sources mounted on the substrate, wherein the plurality of solid state light sources outputs light having a measurable characteristic, and wherein the plurality of solid state light sources includes an adjustable solid state light source, such that the measurable characteristic of the outputted light changes in response to adjustment of the adjustable solid state light source; a sensor, wherein the sensor is configured to detect the measurable characteristic from the outputted light, to compare the measurable characteristic to a baseline value and, based on a result of the comparison, to adjust the adjustable solid state light source; a reflector having a lower edge and an upper edge, wherein the lower edge conforms to the particular shape of the substrate, and wherein the reflector reflects outputted light from the plurality of solid state light sources so that the outputted light exits the luminaire past the upper edge; and a lightguide having an input, wherein the input is surrounded by the reflector and captures a portion of the outputted light so as to provide the captured outputted light to the sensor.

In a related embodiment, the reflector includes: a bottom portion, wherein the bottom portion may include the lower edge and maybe in contact with the substrate, wherein the bottom portion may conform to the particular shape of the substrate, and wherein the input to the lightguide may be formed by an opening in the bottom portion; and a top portion, wherein the top portion may include the upper edge and may be in contact with the bottom portion. In a further related embodiment, the bottom portion of the reflector may be formed of a material capable of being injection molded, and the top portion of the reflector may be formed of a thermally formable material.

In another further related embodiment, the particular shape of the substrate may be defined by an outer edge of the substrate, and the lower edge of the bottom portion of the reflector may be shaped so as to conform to the outer edge of the substrate.

In yet another further related embodiment, the substrate may include an upper surface, the plurality of solid state light sources may be mounted on the upper surface, the particular shape of the substrate may be defined by at least a portion of the upper surface, and the lower edge of the bottom portion of the reflector may be shaped so as to conform to the particular shape of the substrate and so as to cover at least a portion of the upper surface. In a further related embodiment, the upper surface may include at least one additional electrical component located thereon, the particular shape of the substrate may be defined by at least a portion of the upper surface and the at least one additional electrical component thereon, and the lower edge of the bottom portion of the reflector may be shaped so as to conform to the particular shape of the substrate and so as to cover at least a portion of the upper surface and the at least one additional electrical component.

In another related embodiment, the particular shape of the substrate may be defined by an outer edge of the substrate, and the lower edge of the reflector may be shaped so as to conform to the outer edge of the substrate.

In another embodiment, there is provided a luminaire. The luminaire includes: a substrate; a plurality of solid state light sources mounted on the substrate, wherein the plurality of solid state light sources outputs light having a measurable characteristic, and wherein the plurality of solid state light sources includes an adjustable solid state light source, such that the measurable characteristic of the outputted light changes in response to adjustment of the adjustable solid state light source; a sensor, wherein the sensor is configured to detect the measurable characteristic from the outputted light, to compare the measurable characteristic to a baseline value and, based on a result of the comparison, to adjust the adjustable solid state light source; an optic, wherein the outputted light travels through the optic to exit the luminaire; and a lightguide, wherein a portion of the lightguide overlaps a portion of the optic so as to capture a portion of the outputted light that traveled through the optic and to provide the captured outputted light to the sensor.

In a related embodiment, the luminaire may further include: an interior chamber, wherein the plurality of solid state light sources may be located within the interior chamber, wherein at least a portion of the lightguide may surround at least a portion of the interior chamber, and wherein the sensor may be optically separated from the interior chamber except through the lightguide.

In another related embodiment, the portion of the lightguide that overlaps the portion of the optic may be formed so as to allow substantially only the outputted light from the plurality of solid state light sources to be detected by the sensor.

In yet another related embodiment, the sensor may be located on the substrate with the plurality of solid state light sources. In still another related embodiment, the sensor may be part of the lightguide and may be located at the optic, such that the sensor may be the portion of the lightguide that overlaps a portion of the optic.

In yet still another related embodiment, the portion of the optic that is overlapped by the sensor may be opaque, such that the captured outputted light provided to the sensor is from an exterior of the luminaire.

In another embodiment, there is provided a luminaire. The luminaire includes: a substrate having a particular shape; a plurality of solid state light sources mounted on the substrate, wherein the plurality of solid state light sources outputs light; and a hybrid reflector, including: a bottom portion, wherein the bottom portion includes a lower edge and is in contact with the substrate, and wherein the bottom portion conforms to the particular shape of the substrate at the lower edge; and a top portion, wherein the top portion is in contact with the bottom portion and includes an upper edge; wherein the hybrid reflector reflects outputted light from the plurality of solid state light sources so that the outputted light exits the luminaire past the upper edge.

In a related embodiment, the bottom portion of the hybrid reflector may be formed of a material capable of being injection molded, and the top portion of the hybrid reflector may be formed of a thermally formable material. In a further related embodiment, the particular shape of the substrate may be defined by an outer edge of the substrate, and the lower edge of the bottom portion of the hybrid reflector may be shaped so as to conform to the outer edge of the substrate.

In another related embodiment, the substrate may include an upper surface, the plurality of solid state light sources may be mounted on the upper surface, the particular shape of the substrate may be defined by at least a portion of the upper surface, and the lower edge of the bottom portion of the hybrid reflector may be shaped so as to conform to the particular shape of the substrate and so as to cover at least a portion of the upper surface. In a further related embodiment, the upper surface may include at least one additional electrical component located thereon, the particular shape of the substrate may be defined by at least a portion of the upper surface and the at least one additional electrical component thereon, and the lower edge of the bottom portion of the hybrid reflector may be shaped so as to conform to the particular shape of the substrate and so as to cover at least a portion of the upper surface and the at least one additional electrical component.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
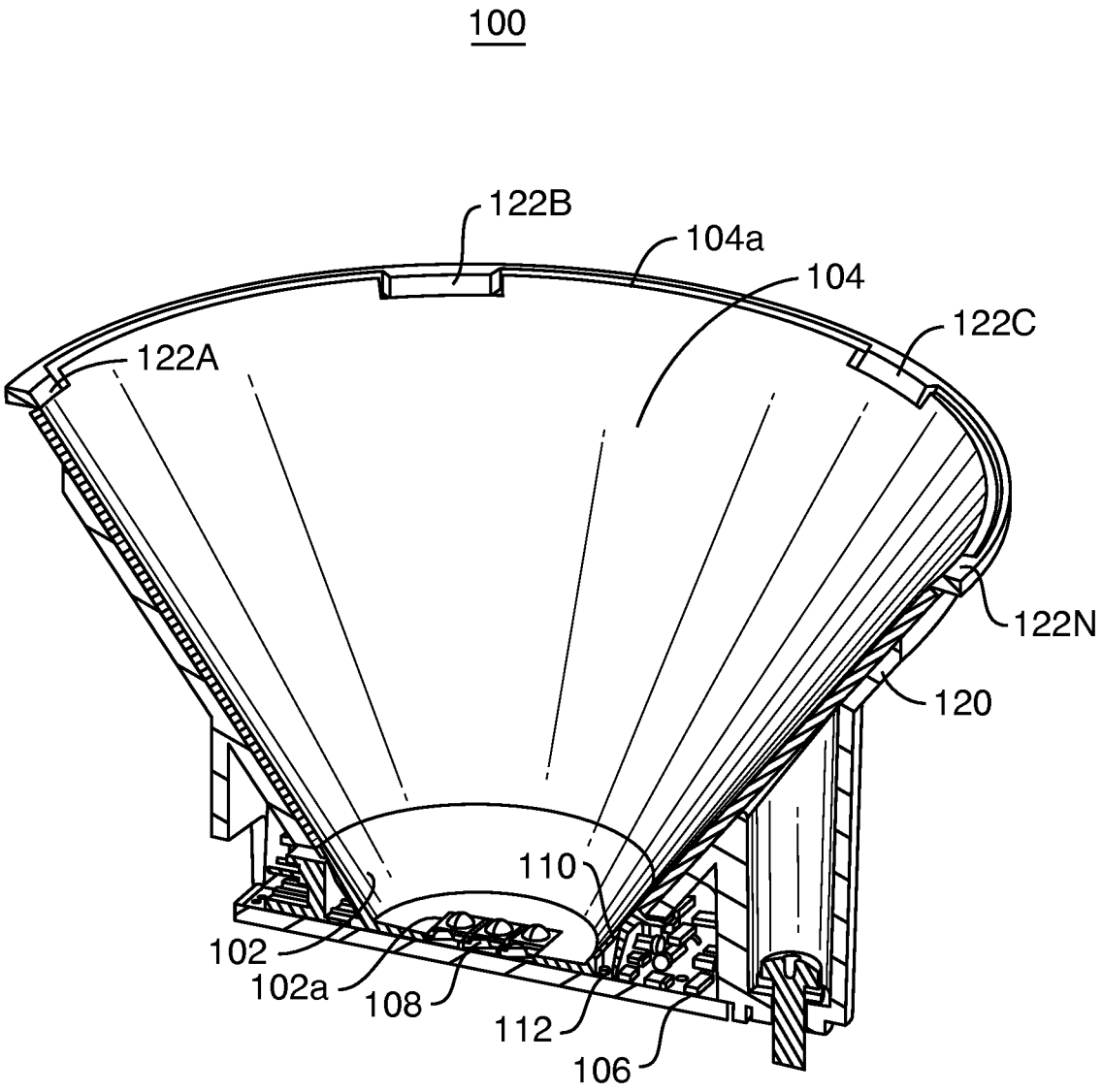
FIG. 1 shows a cross-section of a luminaire including a hybrid reflector and a lightguide for a sensor according to embodiments disclosed herein.

The term luminaire, as used throughout, includes, without limitation, a light bulb, a lamp, a retrofit light bulb, a fixture including any of these or any other light source(s), or combinations thereof. Preferably, the luminaire includes at least one solid state light source, such as but not limited to a light emitting diode (LED), organic light emitting diode (OLED), polymer light emitting diode (PLED), and/or combinations thereof. Thus, though embodiments as shown in the figures are illustrated with respect to a luminaire having a PAR lamp-style shape, embodiments may take many other forms without departing from the scope of the invention.

The phrase "shape of the substrate" and/or "substrate having a particular shape", as used herein, refers to the outer edge(s) of a substrate the surface of which includes at least one solid state light source, and in some embodiments, other components as well) (i.e., the topology of the surface of the substrate), and combinations thereof. Thus, in some embodiments, a hybrid reflector as described herein conforms to at least some portion of one or more outer edges of a substrate. Alternatively, or additionally, in some embodiments, a hybrid reflector as described herein conforms to the entirety of the outer edge(s) of the substrate. Alternatively, or additionally, in some embodiments, a hybrid reflector as described herein conforms to at least a portion of the surface of the substrate that includes the at least one solid state light source. Alternatively, or additionally, in some embodiments, a hybrid reflector as described herein conforms to the shape of a structure on the substrate (e.g., the solid state light sources themselves, other electrical components), such that the solid state light sources are not covered by the hybrid reflector, but substantially all other components on the same surface of the substrate as the solid state light sources are covered by the hybrid reflector.

Creating a reflector that conforms to a particular shape usually requires injection molding. In the current state of the art, the most reflective injection-moldable material that is usable in a lighting application has a reflectance of 95% or less. An example of such an injection-moldable material is Bayer® Makrolon 6265. On the other hand, it is easy to find thermally formable materials usable in a light application that have a reflectance of 99% or greater. However, when the shape to which the reflector must mate is a complicated geometric shape, as opposed to a simple geometric shape (e.g., circle, oval, square, etc.), the material used to create the reflector must be capable of being shaped to conform to the complicated geometric shape. One cannot make a conforming complicated geometric shape with thermally formable materials. If thermally formable materials, such as but not limited to microfoamed polyethylene terephthalate (PET) materials made by Furukawa, are used to make a conforming geometric shape, the material must, in some embodiments, be bent so as to form sharp corners. It is very difficult to bend a microfoamed PET material to form a sharp corner. Further, by changing the shape of the material to match a complicated geometric shape, the material itself could lose its high reflectance. It is inherent to the thermoforming of such materials to complex shapes that the optical properties are compromised as the material looses thickness or is compressed to conform to complicated geometric shapes. The high reflectance is typically only achieved at the original material stock thickness. Further, in embodiments where the reflector is conformed to a portion of the topology of the surface, of course the surface is not flat and/or smooth due to the presence of components on the surface (i.e., the solid state light sources, sensor(s), resistor(s), etc.), and it is impossible to change the thickness of the material such that the material would be both conformal and smooth.

Embodiments overcome such issues by providing for a hybrid reflector having a bottom portion made of an injection moldable material and a top portion made of a thermally formable material. The bottom portion of the hybrid reflector is shaped in part according to the shape of the substrate and/or the components located thereon, such that it is able to conform, in part, to the shape of the substrate and/or the components located thereon, while the top portion takes a typical reflector shape (e.g., a conical shape) that is easily formed from a thermally formable material.

FIG. 1 shows a cross-section of a luminaire 100 including a hybrid reflector 102, 104 and a lightguide 110. The luminaire 100 also includes a substrate 106, such as but not limited to a printed circuit board (PCB) or the like material, on which is located a plurality of solid state light sources 108. The plurality of solid state light sources 108 are of any color, i.e., some solid state light sources are a first color, some are a second color, some are a third color, etc. Thus, in some embodiments, the plurality of solid state light sources 108 use one or more color mixing techniques, as are known in the art, to create white light. Of course, in some embodiments, all the solid state light sources in the plurality of solid state light sources 108 are of the same, and/or substantially the same, color. The plurality of solid state light sources 108 outputs light having a measurable characteristic, such as but not limited to color, color temperature, brightness (intensity), and the like. The plurality of solid state light sources 108 includes at least one, and in some embodiments many, adjustable solid state light source(s), such that the measurable characteristic of the outputted light changes in response to adjustment of the adjustable solid state light source. In some embodiments, the term "outputted light" refers to light that exits the plurality of solid state light sources 108 but that has not yet exited the luminaire 100, while in other embodiments, it refers to light that has exited the luminaire 100.

Though the cross-section of the luminaire 100 that is shown in FIG. 1 is substantially in the shape of a traditional PAR lamp, the luminaire 100 may be of any shape as described above, and as seen in, for example, FIG. 4, which shows a cross-section of a luminaire 100*a* having a substantially rectangular shape.

Figure 4:
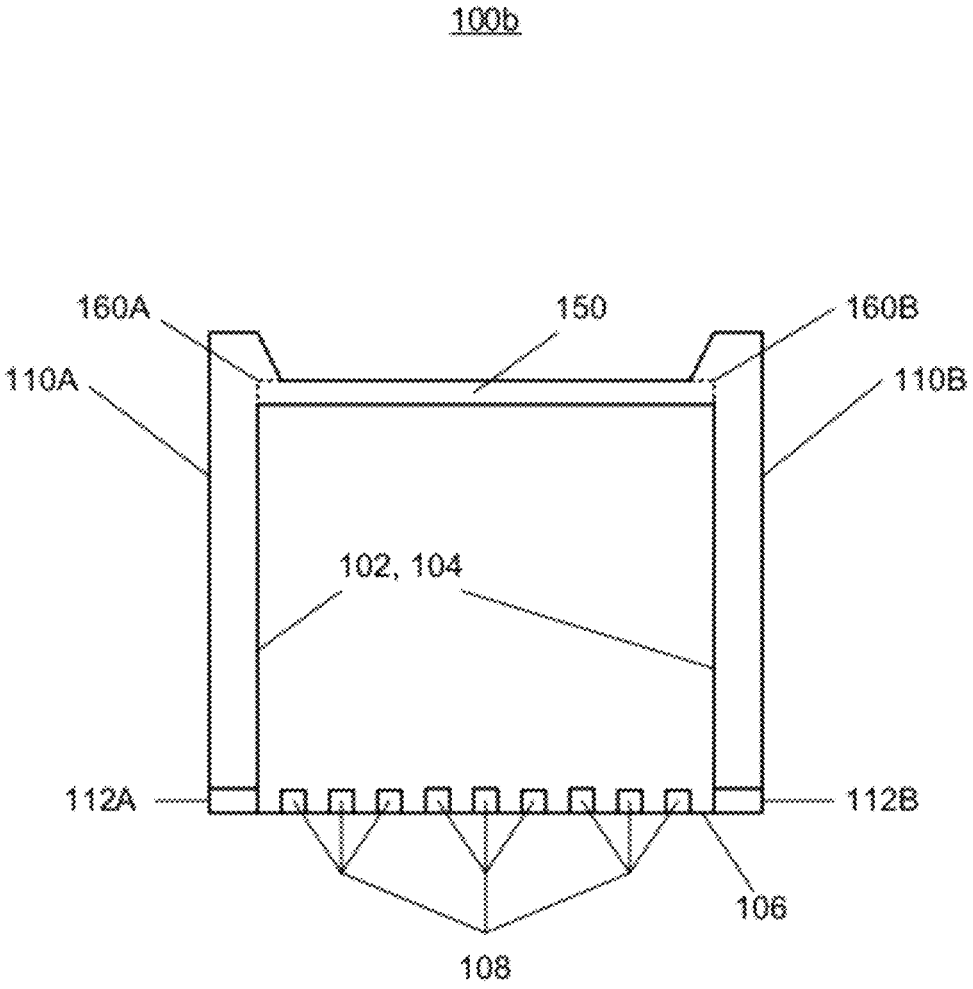
FIG. 4 shows a substantially rectangular cross-section of a luminaire including lightguides for sensors according to embodiments disclosed herein.
Figure 5:
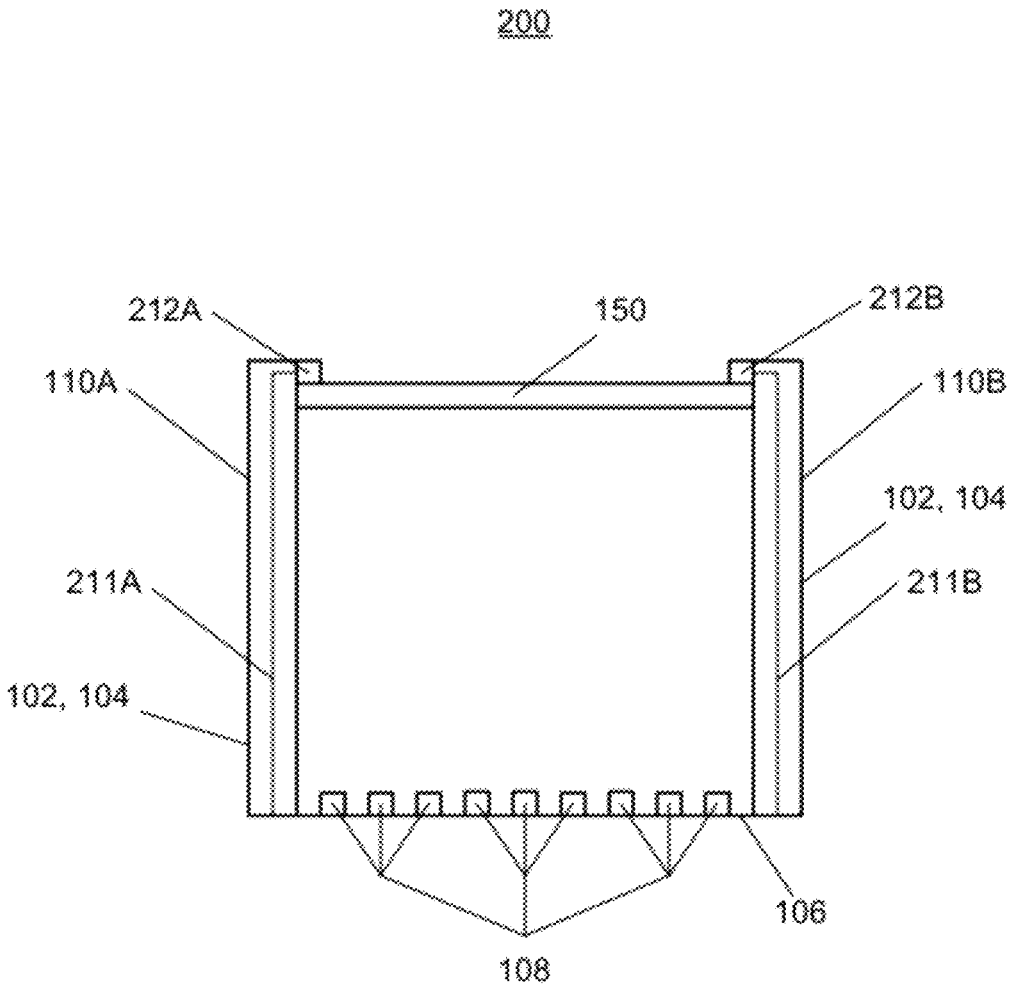
FIG. 5 shows a substantially rectangular cross-section of a luminaire including lightguides for sensors according to embodiments disclosed herein.

The substrate 106 also includes at least one other electrical component, a sensor 112. The sensor 112 in FIG. 1 is located at the bottom of the lightguide 110. In FIG. 1, the sensor 112 is isolated from direct contact with the plurality of solid state light sources 108, except as otherwise described herein, via a bottom portion 102 of a hybrid reflector 102, 104. The bottom portion 102 of the hybrid reflector 102, 104 includes a lightguide 110, as stated above, where the lightguide 110 includes an opening, through which light emitted by the plurality of solid state light sources 108 is able to pass, and a path to the sensor 112. In such embodiments, the sensor 112 receives light before it has passed out of the luminaire (e.g., through an exit optic 150 such as is shown in FIGS. 4 and 5, but is not shown in FIG. 1). The location of the sensor 112 and/or the location of the opening of the lightguide 110 is/are chosen to optimize one or more characteristics of the light being sensed by the sensor 112 via the lightguide 110. Of course, in some embodiments, more than one sensor 112, and, in some embodiments, a corresponding number of additional lightguides, is/are used.

The sensor 112 is configured to detect the measurable characteristic from the outputted light. The sensor 112 then compares the measurable characteristic to a baseline value. For example, in embodiments where the measurable characteristic is color temperature, the sensor will detect the color temperature of the outputted light, say 3000K, and compare it to a baseline value, say 3050K. Based on a result of the comparison, the sensor 112 may, and in some embodiments does, adjust the adjustable solid state light source, for example to make the measurable characteristic of the outputted light the same and/or substantially the same as the baseline value. In some embodiments, of course, the sensor 112 at a given moment in time may have no adjustment to make, if the measured characteristic is the same as, or substantially the same as, the baseline value. The baseline value(s) for any given measurable characteristic may be stored in a memory system that is located within the sensor 112, in another component on the substrate 106 in connection with the sensor 112, or in a different portion of the luminaire 100 though still in connection with the sensor 112. In some embodiments, the memory system may be external to the luminaire 100 and in such embodiments, the sensor 112 communicates with the memory system using any known method (e.g., wireless communication). In some embodiments, such as is described herein in greater detail with regards to FIGS. 4 and 5, the lightguide 110 has an input (e.g., an opening 160A shown in FIG. 4) that is surrounded by the hybrid reflector 102, 104 and captures a portion of the outputted light so as to provide the captured outputted light to the sensor 112.

Figure 2:
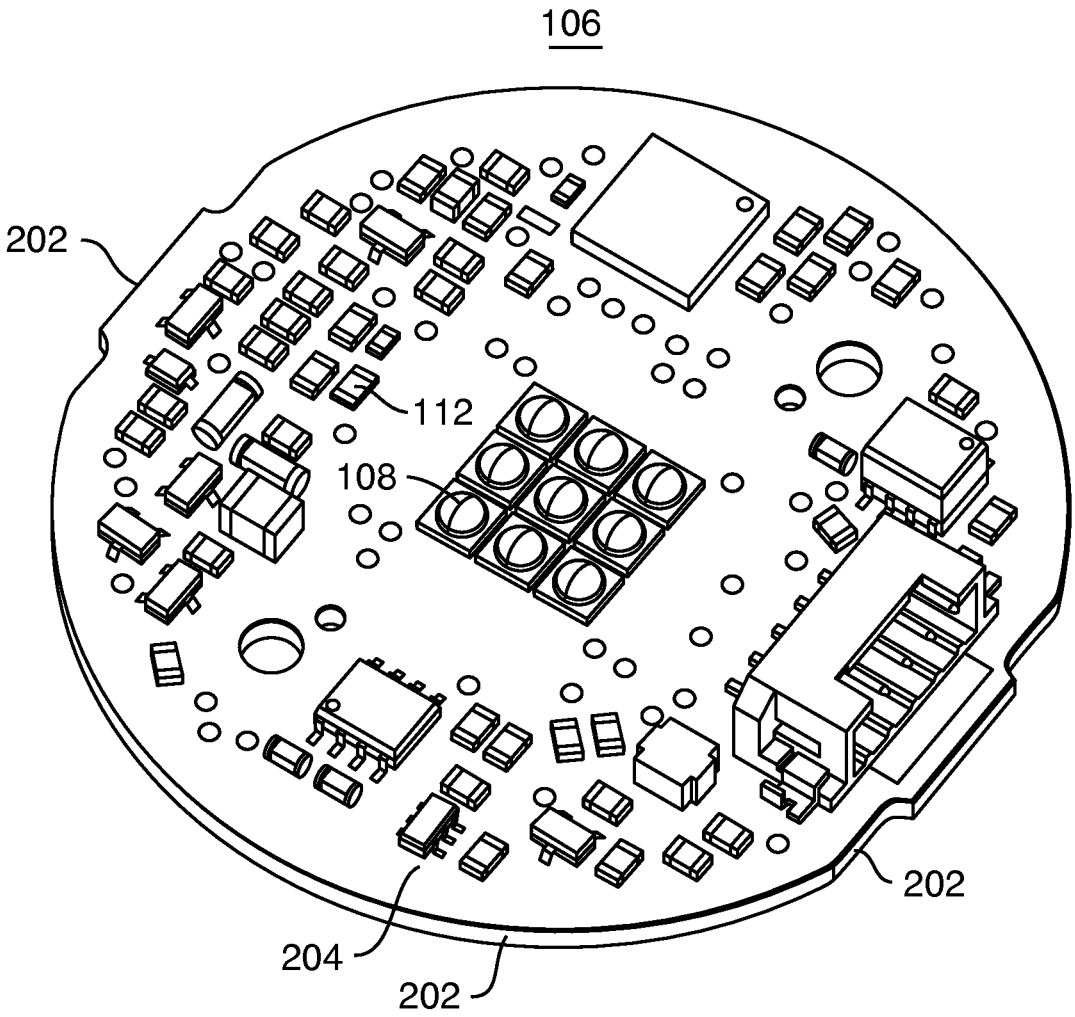
FIG. 2 shows a substrate having a particular shape and including a plurality of solid state light sources and other components according to embodiments disclosed herein.

FIG. 2 shows the substrate 106 of FIG. 1 in greater detail, removed from the luminaire 100. The substrate 106 has a surface 204 that is capable of supporting a plurality of solid state light sources 108, a sensor 112, and/or other components, devices, and the like. The substrate 106 also includes an outer edge 202. When viewed in a two-dimensional cross-section where the outer edge 202 defines the cross section, the substrate 106 may be said to have a complicated geometric shape. That is, the outer edge 202 of the substrate 106 shown in FIG. 2 does not follow a standard, simple geometric shape, such as a circle, oval, square, rectangle, or the like, but rather has a quasi-circular shape that includes two flattened ends, each slightly curved inward and then outward to an extruding portion that is substantially linear. Similarly, the topology of the surface 204 of the substrate 106, created by the plurality of solid state light sources 108, the sensor 112, and the other components on the substrate 106 is also a complicated geometric shape, rising and falling depending on (among other things) the distance between components, the size of components, and the like. Thus, the geometric shape of the surface 204 of the substrate 106 is not easily described as a typical, well-known geometric shape in either two dimensions (i.e., circle, oval, square, etc.) or three dimensions (i.e., sphere, pyramid, cube, etc.). To form an opening of a reflector to fit around the complicated geometric shape of the substrate 106 shown in FIG. 2 (whether its edges 202, surface 204 (i.e., topology), or combinations thereof), using a thermally formable material, is not easy for the reasons described above. However, it is easy to injection mold or otherwise shape a material capable of being injection molded into a shape that will conform to the substrate 106 and/or to a portion thereof. Thus, as described below, a bottom portion 102 of the hybrid reflector 102, 104 is formed from such a material, so that the bottom portion 102 of the hybrid reflector 102, 104 is able to conform and/or substantially conform to the substrate 106 (whether its edges, topology, or combinations thereof). This allows the hybrid reflector 102, 104 to collect as much light as possible from the plurality of solid state light sources 108.

The hybrid reflector 102, 104 includes a bottom portion 102 and a top portion 104. The bottom portion 102 is that portion of the hybrid reflector 102, 104 that is closest to a surface of the substrate 106, where the surface includes at least one light source (e.g., a solid state light source in the plurality of solid state light sources 108). The bottom portion has a lower edge 102*a* that conforms to the particular shape of the substrate 106 (e.g., to the plurality of solid state light sources 108 located thereon). The top portion 104 includes an upper edge 104*a* past which outputted light from the plurality of solid state light sources 108 exits the luminaire 100.

The bottom portion 102 is made of a material that is capable of being shaped to surround a complicated geometric shape, but that still has a high reflectance. In some embodiments, the bottom portion 102 is made from a material capable of being injection molded, such as but not limited to a polycarbonate or polycarbonate and acrylonitrile butadiene styrene blend, or combinations thereof. The reflectance of the bottom portion 102, in some embodiments, is lower than the reflectance of the top portion 104. Alternatively, or additionally, the bottom portion 102 has the same reflectance as the top portion 104. Alternatively, or additionally, the bottom portion 102 has nearly the same reflectance as the top portion 104. Alternatively, or additionally, the reflectance of the bottom portion 102 is less than the reflectance of the top portion 104. In some embodiments, the reflectance of the bottom portion 102 is 95%. Alternatively, or additionally, in some embodiments, the reflectance of the bottom portion 102 is substantially 95%. Alternatively, or additionally, in some embodiments, the reflectance of the bottom portion 102 is less than 95%. In some embodiments, the lightguide 110 is formed at least in part by an opening in the bottom portion 102, as it is easier to form such an opening in the injection moldable material of the bottom portion 102 than in the thermally formable material of the top portion 104.

The top portion 104 is made of a material that that has as high a reflectance as possible, such as but not limited to a thermally formable material, such as but not limited to microfoamed PET as described above. In some embodiments, the top portion 104 has a reflectance of 99%. Alternatively, or additionally, the reflectance of the top portion 104 is substantially 99%. The top portion 104 is adjacent to the bottom portion 102. FIG. 1 shows the bottom portion 102 and the top portion 104 in contact with each other, such that no gap and/or substantially no gap (whether of air, other material, or the like) exists in-between. Thus, the bottom portion 102 and the top portion 104 of the hybrid reflector 102, 104, in some embodiments, are not permanently joined together, but rather are shaped so as to at least rest adjacent to each other when placed in a luminaire, such as the luminaire 100 shown in cross-section in FIG. 1. Alternatively, or additionally, there may be a mechanical connection between the bottom portion 102 and the top portion 104 that is capable of being unconnected and re-connected as desired (not shown in FIG. 1). Such a mechanical connection is achieved using any type of mechanical connection known in the art, such as but not limited to a protrusion (i.e., extruding post) and an opening for receiving same and/or a plurality of protrusions and openings for receiving same. In some embodiments, the mechanical connection when engaged allows the bottom portion 102 and the top portion 104 to remain adjacent to each other, with no gap and/or substantially no gap (whether of air, other material, or the like) in-between. Of course, in some embodiments, a gap (not shown in FIG. 1) exists between the bottom portion 102 and the top portion 104 of the hybrid reflector 102, 104, whether of air or another material. For example, a housing of the luminaire 100 on which the hybrid reflector 102, 104 sits may include an extending piece that helps to hold the bottom portion 102 in position and on which the top portion 104 sits. In such embodiments, the extending piece is itself reflective, being made of either a reflective material or having a reflective coating.

Figure 3:
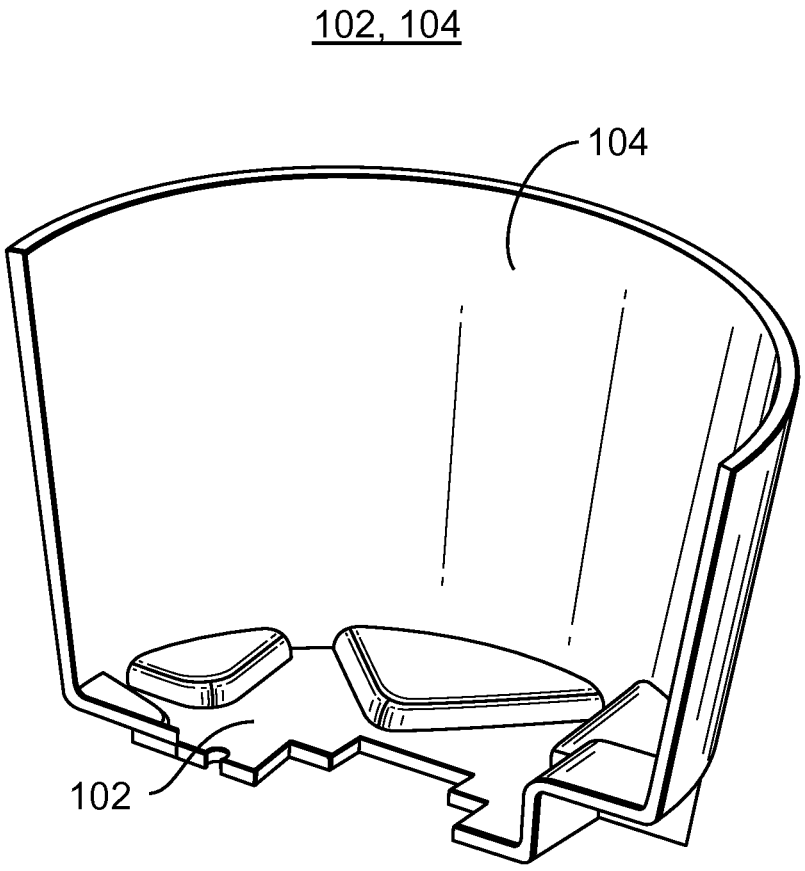
FIG. 3 shows a hybrid reflector shaped to cover a substrate according to embodiments disclosed herein.

As shown in FIG. 1, the bottom portion 102 of the hybrid reflector 102, 104 is shaped so as to cover that portion of the substrate 106 (not shown) that does not include the plurality of solid state light sources 108 (not shown). Thus, in FIG. 3, the bottom portion 102 of the hybrid reflector 102, 104 itself conforms to the topology (whether complicated or otherwise) of a surface of the substrate 106 (such as the surface of the substrate 106 shown in FIG. 2).

Of course, in some embodiments, the hybrid reflector 100 is used with a surface that does not have a complicated geometric shape. For example, in some embodiments, the hybrid reflector 102, 104 is switched from a first luminaire, where the surface has a complicated geometric shape, to a second luminaire, where the surface has a non-complicated geometric shape. In such embodiments, for example, a cover may be placed on the substrate of the second luminaire so as to address any portion of the substrate of the second luminaire that is not covered by the bottom portion 102 of the hybrid reflector 102, 104. Alternatively, or additionally, a new (i.e., second) bottom portion 102 is formed that conforms to the shape of the substrate of the second luminaire (whether its edges, surface, topology, or combinations thereof). Alternatively, or additionally, only the top portion 104 of the hybrid reflector 100 is moved from the first luminaire to the second luminaire. Thus, both the first luminaire and the second luminaire have their own respective bottom portion of a hybrid reflector—that of the first luminaire formed to match the shape of its substrate, that of the second luminaire formed to the shape of its substrate. In embodiments where the bottom portion of the hybrid reflector 102, 104 is formed to match a non-complicated geometric shape, the bottom portion may be, but is not limited to being, made from any type of material, including but not limited to a thermally formable material (e.g., the same material as the top portion 104), an injection-moldable material, or any other material having some value of reflectance and capable of being used in a lighting application.

Note that, in FIG. 1, the hybrid reflector 102, 104 does not conform to the shape of the entire surface of the substrate 106, but rather to only a portion of the surface of the substrate 106 that includes the plurality of solid state light sources 108.

In some embodiments, such as shown in FIG. 1, the top portion 104 of the hybrid reflector is supported by a support structure 120. The support structure 120 surrounds at least a portion of the top portion 104 and, in some embodiments, assists in holding the top portion 104 (and thus, in some embodiments, the hybrid reflector 102, 104) in place in the luminaire 100. Alternatively or additionally, the support structure 120, in some embodiments, keeps and/or assists with keeping the top portion 104 in contact and/or in substantially close contact with the bottom portion 102. Sections of the support structure 120, such as a plurality of holding tabs 122A, 122B, 122C, . . . , 122N shown in FIG. 1, may be, and in some embodiments are, reflective themselves, that is, made from a reflective material and/or have a reflective coating, so as to increase the overall amount of reflected light within the luminaire 100.

FIG. 4 shows a substantially rectangular cross-section of a luminaire 100*b* having a plurality of solid state light sources 108 located on a substrate 106. The substrate 106 includes other components, such as but not limited to a plurality of sensors 112A, 112B, . . . 112N. Each sensor in the plurality of sensors 112A, 112B, . . . 112N is capable of detecting one or more different components of light (e.g., color temperature) and adjusting one or more characteristics of at least one solid state light source in the plurality of solid state light sources 108. Each sensor in the plurality of sensors 112A, 112B, . . . 112N, though mounted on the same substrate 106 as the plurality of solid state light sources 108, is isolated from the plurality of solid state light sources, except as described herein. This isolation is necessary so that each sensor in the plurality of sensors 112A, 112B, . . . 112N is able to sense the entirety of any color-mixed light created within the luminaire 100, without instead (or additionally) sensing the output of a single solid state light source (e.g., the solid state light source closest in proximity to the sensor on the substrate). In some embodiments, such as shown in more detail in FIG. 3, this isolation is accomplished through use of a reflector that covers the sensor and surrounds the plurality of solid state light sources 108. Of course, in some embodiments, such as is shown in FIG. 1, the isolation of a sensor 112 from the plurality of solid state light sources 108 may be arranged such that the sensor 112 is able to sense the output of a single solid state light source and/or a subset of the plurality of solid state light sources 108, wherein all solid state light sources in the subset may share a similar or same characteristic.

The plurality of sensors 112A, 112B, . . . 112N is not entirely isolated from the plurality of solid state light sources 108. More specifically, each sensor in the plurality of sensors 112A, 112B, . . . 112N receives light from the plurality of solid state light sources 108 via a corresponding lightguide in a plurality of lightguides 110A, 110, . . . 110N. Each lightguide in the plurality of lightguides 110A, 110B, . . . 110N is positioned such that a portion of the lightguide protrudes onto a portion of a surface of an exit optic 150. The exit optic 150 is the optic through which light, initially emitted by the plurality of solid state light sources 108, exits the luminaire 100*b* . The light captured by a lightguide in the plurality of lightguides 110A, 110B, . . . 110N is transmitted to its respective sensor in the plurality of sensors 112A, 112B, . . . 112N using, in some embodiments, total internal reflection, which is achieved using any techniques known in the art (e.g., mirrors, reflective coatings on the interior of the lightguide, fiber optics, etc.). The light travels through the exit optic 150 and enters the plurality of lightguides 110A, 110B, . . . 110N via a plurality of openings 160A, 160B, . . . 160N. The plurality of openings 160A, 160B, . . . 160N keep substantially all exterior light (i.e., ambient light) out of the plurality of lightguides 110A, 110B, . . . 110N, while capturing the light after it passes through the exit optic 150. This is achieved by each lightguide in the plurality of lightguides 110A, 110B, . . . 110N including a portion that overlaps a portion of the exit optic 150, with each opening in the plurality of openings 160A, 160B, . . . 160N being between the overlapping portion of the corresponding lightguide and the exit optic 150.

The advantage of gathering light after it has passed through the exit optic 150 is that the light sensed by the plurality of sensors 112A, 112B, . . . 112N is substantially similar in terms of characteristics to the light that is perceived by an observer as being emitted from the luminaire 100*b*. Thus, any adjustment(s) made to any of the plurality of solid state light sources 108 by one or more sensors in the plurality of sensors 112A, 112B, . . . 112N are based on the actual output of the luminaire 100*b*, and not necessarily the output of the plurality of solid state light sources 108 prior to total color mixing and the effects (if any) of the exit optic 150, though of course, in some embodiments as described herein, such sensing prior to total color mixing and the effects (if any) of the exit optic 150 are desirable.

In FIG. 4, the luminaire 100*b* includes a hybrid reflector 102, 104 as described herein, where the plurality of lightguides 110A, 110B, . . . 110N is outside of the hybrid reflector 102, 104, in contrast to FIG. 1 and FIG. 5. In such embodiments, the shape of the plurality of lightguides 110A, 110B, . . . 110N may conform and/or substantially conform to the exterior shape of the hybrid reflector 102, 104. Of course, in some embodiments, the hybrid reflector 102, 104 may surround the plurality of lightguides 110A, 110B, . . . 110N, as is shown in FIG. 5. The plurality of lightguides 110A, 110B, . . . 110N thus surround at least a portion of an interior chamber of the luminaire 100*b*, in which the plurality of solid state light sources 108 is located.

FIG. 5 shows a substantially rectangular cross-section of a luminaire 200 where a plurality of sensors 212A, 212B, . . . 212N, instead of being co-located on the substrate 106 with the plurality of solid state light sources 108, are located adjacent to the exit optic 150. Each sensor in the plurality of sensors 212A, 212B, . . . 212N is connected to the plurality of solid state light sources 108 via an electrical connection, such as but not limited to a lead wire in a plurality of lead wires 211A, 211B, . . . 211N. The portion of each lightguide in the plurality of lightguides 110A, 110B, . . . 110N that is directly adjacent to the exit optic 150 is shielded such that light enters each respective lightguide in the plurality of lightguides 110A, 110B, . . . 110N only via the appropriate sensor in the plurality of sensors 212A, 212B, . . . 212N. Further, in some embodiments, the portion of each sensor in the plurality of sensors 212A, 212B, . . . 212N that is directly adjacent to the exit optic 150 is shielded, such that light is detected by the respective sensor in the plurality of sensors 212A, 212B, . . . 212N after the light has left the exit optic 150 and entered the medium surrounding an exterior of the luminaire 200. In some embodiments, the portion of the exit optic 150 that is beneath the plurality of sensors 212A, 212B, . . . 212N is made opaque and/or otherwise removed.

In FIG. 5, the luminaire 200 includes a hybrid reflector 102, 104 as described herein, wherein the hybrid reflector 102, 104 partially forms an exterior of the luminaire 200 and thus surrounds the plurality of lightguides 110A, 110B, . . . 110N.

Though embodiments have been described herein as having a one to one ratio of sensors to lightguides, the invention is not so limited. Thus, in some embodiments, a single lightguide as described herein brings light to more than one sensor, for example but not limited to two sensors, three sensors, etc. Each sensor may be configured to detect a particular characteristic of the light either outputted from the luminaire or from the plurality of solid state light sources, and to make a corresponding adjustment, if needed, to one or more solid state light sources in the plurality of solid state light sources.

Though embodiments of a lightguide have been illustrated herein as being as straight and/or substantially straight pipe-shape, of course a lightguide may take any shape that allows light to be transmitted to a sensor. For example, in some embodiments, a lightguide may be wider in proximity to the sensor and narrower where the light enters the lightguide. Alternatively, or additionally, a lightguide may be wider where the light enters the lightguide and narrower in proximity to the sensor. In preferred embodiments, the shape of the lightguide in proximity to the sensor (or sensors) should be as similar to the shape of the sensor (or sensors) as possible. Additionally, or alternatively, the lightguide may be shaped so as to follow the shape of an internal component, such as a hybrid reflector, that the lightguide is in close and/or substantial proximity to, so that the lightguide more easily fits within the luminaire.

The number of lightguides used in embodiments varies in relation to the number and/or types of solid state light sources used. Thus, in embodiments where all of the solid state light sources emit white light, a fewer number of lightguides may be needed than in embodiments where the solid state light sources use color mixing to produce white light.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art

What is claimed is:

1. A luminaire, comprising:

a substrate having a particular shape;

a plurality of solid state light sources mounted on the substrate, wherein the plurality of solid state light sources outputs light having a measurable characteristic, and wherein the plurality of solid state light sources includes an adjustable solid state light source, such that the measurable characteristic of the outputted light changes in response to adjustment of the adjustable solid state light source;

a sensor, wherein the sensor is configured to detect the measurable characteristic from the outputted light, to compare the measurable characteristic to a baseline value and, based on a result of the comparison, to adjust the adjustable solid state light source;

a reflector having a lower edge and an upper edge, wherein the lower edge conforms to the particular shape of the substrate, and wherein the reflector reflects outputted light from the plurality of solid state light sources so that the outputted light exits the luminaire past the upper edge; and a lightguide having an input, wherein the input is surrounded by the reflector and captures a portion of the outputted light so as to provide the captured outputted light to the sensor.

2. The luminaire of claim 1, wherein the reflector comprises:

a bottom portion, wherein the bottom portion includes the lower edge and is in contact with the substrate, wherein the bottom portion conforms to the particular shape of the substrate, and wherein the input to the lightguide is formed by an opening in the bottom portion; and a top portion, wherein the top portion includes the upper edge and is in contact with the bottom portion.

3. The luminaire of claim 2, wherein the bottom portion of the reflector is formed of a material capable of being injection molded, and wherein the top portion of the reflector is formed of a thermally formable material.

4. The luminaire of claim 2, wherein the particular shape of the substrate is defined by an outer edge of the substrate, and wherein the lower edge of the bottom portion of the reflector is shaped so as to conform to the outer edge of the substrate.

5. The luminaire of claim 2, wherein the substrate includes an upper surface, wherein the plurality of solid state light sources is mounted on the upper surface, wherein the particular shape of the substrate is defined by at least a portion of the upper surface, and wherein the lower edge of the bottom portion of the reflector is shaped so as to conform to the particular shape of the substrate and so as to cover at least a portion of the upper surface.

6. The luminaire of claim 5, wherein the upper surface includes at least one additional electrical component located thereon, wherein the particular shape of the substrate is defined by at least a portion of the upper surface and the at least one additional electrical component thereon, and wherein the lower edge of the bottom portion of the reflector is shaped so as to conform to the particular shape of the substrate and so as to cover at least a portion of the upper surface and the at least one additional electrical component.

7. The luminaire of claim 1, wherein the particular shape of the substrate is defined by an outer edge of the substrate, and wherein the lower edge of the reflector is shaped so as to conform to the outer edge of the substrate.

8. A luminaire, comprising:

a substrate;

a plurality of solid state light sources mounted on the substrate, wherein the plurality of solid state light sources outputs light having a measurable characteristic, and wherein the plurality of solid state light sources includes an adjustable solid state light source, such that the measurable characteristic of the outputted light changes in response to adjustment of the adjustable solid state light source;

a sensor, wherein the sensor is configured to detect the measurable characteristic from the outputted light, to compare the measurable characteristic to a baseline value and, based on a result of the comparison, to adjust the adjustable solid state light source;

an optic, wherein the outputted light travels through the optic to exit the luminaire; and a lightguide, wherein a portion of the lightguide overlaps a portion of the optic so as to capture a portion of the outputted light that traveled through the optic and to provide the captured outputted light to the sensor.

9. The luminaire of claim 8, further comprising:

an interior chamber, wherein the plurality of solid state light sources is located within the interior chamber, wherein at least a portion of the lightguide surrounds at least a portion of the interior chamber, and wherein the sensor is optically separated from the interior chamber except through the lightguide.

10. The luminaire of claim 8, wherein the portion of the lightguide that overlaps the portion of the optic is formed so as to allow substantially only the outputted light from the plurality of solid state light sources to be detected by the sensor.

11. The luminaire of claim 8, wherein the sensor is located on the substrate with the plurality of solid state light sources.

12. The luminaire of claim 8, wherein the sensor is part of the lightguide and is located at the optic, such that the sensor is the portion of the lightguide that overlaps a portion of the optic.

13. The luminaire of claim 8, wherein the portion of the optic that is overlapped by the liqhtquide is opaque, such that the captured outputted light provided to the sensor is from an exterior of the luminaire.

14. A luminaire, comprising:

a substrate having a particular shape;

a plurality of solid state light sources mounted on the substrate, wherein the plurality of solid state light sources outputs light; and a hybrid reflector, comprising:

a bottom portion, wherein the bottom portion includes a lower edge and is in contact with the substrate, and wherein the bottom portion conforms to the particular shape of the substrate at the lower edge; and a top portion, wherein the top portion is in contact with the bottom portion and includes an upper edge;

wherein the hybrid reflector reflects outputted light from the plurality of solid state light sources so that the outputted light exits the luminaire past the upper edge.

15. The luminaire of claim 14, wherein the bottom portion of the hybrid reflector is formed of a material capable of being injection molded, and wherein the top portion of the hybrid reflector is formed of a thermally formable material.

16. The luminaire of claim 15, wherein the particular shape of the substrate is defined by an outer edge of the substrate, and wherein the lower edge of the bottom portion of the hybrid reflector is shaped so as to conform to the outer edge of the substrate.

17. The luminaire of claim 15, wherein the substrate includes an upper surface, wherein the plurality of solid state light sources is mounted on the upper surface, wherein the particular shape of the substrate is defined by at least a portion of the upper surface, and wherein the lower edge of the bottom portion of the hybrid reflector is shaped so as to conform to the particular shape of the substrate and so as to cover at least a portion of the upper surface.

18. The luminaire of claim 17, wherein the upper surface includes at least one additional electrical component located thereon, wherein the particular shape of the substrate is defined by at least a portion of the upper surface and the at least one additional electrical component thereon, and wherein the lower edge of the bottom portion of the hybrid reflector is shaped so as to conform to the particular shape of the substrate and so as to cover at least a portion of the upper surface and the at least one additional electrical component.

* * * * *